US010618273B2

(12) United States Patent
Chen et al.

(10) Patent No.: US 10,618,273 B2
(45) Date of Patent: Apr. 14, 2020

(54) SCREEN PRINTING DEVICE AND METHOD FOR ADJUSTING TENSION IN PRINTING MESH THEREOF

(71) Applicants: BOE TECHNOLOGY GROUP CO., LTD., Beijing (CN); ORDOS YUANSHENG OPTOELECTRONICS CO., LTD., Ordos, Inner Mongolia (CN)

(72) Inventors: Jingjing Chen, Beijing (CN); Xuefei Bai, Beijing (CN); Xuansheng Wang, Beijing (CN); Yedong Wang, Beijing (CN)

(73) Assignees: BOE TECHNOLOGY GROUP CO., LTD., Beijing (CN); ORDOS YUANSHENG OPTOELECTRONICS CO., LTD., Ordos (CN)

( * ) Notice: Subject to any disclaimer, the term of this patent is extended or adjusted under 35 U.S.C. 154(b) by 15 days.

(21) Appl. No.: 16/039,584

(22) Filed: Jul. 19, 2018

(65) Prior Publication Data

US 2019/0143670 A1 May 16, 2019

(30) Foreign Application Priority Data

Nov. 10, 2017 (CN) ..... 2017 1 1102023

(51) Int. Cl.
*B41F 15/36* (2006.01)
*B41M 1/12* (2006.01)
(Continued)

(52) U.S. Cl.
CPC ..... *B41F 25/00* (2013.01); *B41F 15/0881* (2013.01); *B41F 15/36* (2013.01); *B41F 15/44* (2013.01)

(58) Field of Classification Search
CPC ..... B41F 15/34; B41F 15/36; B41F 15/0813; B41F 15/0845; B41F 15/0881; B41F 25/00; H05K 3/1216; H05K 3/1225; B41M 1/12
(Continued)

(56) References Cited

U.S. PATENT DOCUMENTS 3,962,805 A 6/1976 Hamu
5,220,867 A * 6/1993 Carpenter ..... B41F 15/36 101/127.1
(Continued)

FOREIGN PATENT DOCUMENTS

CN 101426650 A 5/2009
CN 101497255 A 8/2009
(Continued)

OTHER PUBLICATIONS

China First Office Action, Application No. 201711102023.3, dated Sep. 20, 2018, 24 pps.: with English translation.

*Primary Examiner* — Leslie J Evanisko
(74) *Attorney, Agent, or Firm* — Armstrong Teasdale LLP

(57) ABSTRACT

The present disclosure provides a screen printing device, including a printing screen having a printing mesh and a mesh frame, and a squeegee blade, wherein the printing mesh has first and second longitudinal ends, first and second blank areas, and a printing portion with printed patterns between the first and second blank areas, which being movably connected to the mesh frame by a tension adjusting mechanism respectively and being provided with at least one tension sensor respectively approximate to the printing portion, wherein the device further has a control means for receiving a tension measurement value from the tension sensor and compare it with a reference value so as to control the tension adjustment mechanism to adjust the tension in
(Continued)

the printing mesh. The disclosure further provides a method for adjusting the tension of the printing mesh of the screen printing device.

8 Claims, 2 Drawing Sheets

(51) Int. Cl.
*B41F 25/00* (2006.01)
*B41F 15/44* (2006.01)
*B41F 15/08* (2006.01)

(58) Field of Classification Search
USPC ..... 101/127, 127.1
See application file for complete search history.

(56) References Cited

U.S. PATENT DOCUMENTS

| | | | | |
|---|---|---|---|---|
| 7,836,778 | B2 * | 11/2010 | Kleinschnitz ..... | B41F 15/36 73/159 |
| 2009/0151578 | A1 * | 6/2009 | Kleinschnitz ..... | B41F 15/36 101/128.4 |

FOREIGN PATENT DOCUMENTS

| | | | |
|---|---|---|---|
| CN | 102169039 | A | 8/2011 |
| JP | 4173246 | A | 6/1992 |
| WO | 2015177174 | A2 | 11/2015 |

* cited by examiner

SCREEN PRINTING DEVICE AND METHOD FOR ADJUSTING TENSION IN PRINTING MESH THEREOF

CROSS REFERENCE TO RELATED APPLICATIONS

This patent application claims priority to Chinese Patent Application No. 201711102023.3 filed on Nov. 10, 2017, the disclosure of which is incorporated by reference herein in its entirety as part of the present application.

BACKGROUND

The embodiments of the present disclosure generally relate to the field of organic light emitting diode (OLED) packaging processes, and more particularly to a screen printing device and a method for adjusting the tension in a printing mesh thereof.

A glass glue printing process refers to a process of printing glass glue on a packaging glass by screen printing technology. In this process, there will be a certain offset between a glass glue printed pattern and a target pattern, and a greater offset may affect the packaging effect.

In the present glass glue printing screen, a middle mesh is fixed by an outer frame, i.e., the middle mesh is fixedly connected to the outer frame and cannot be adjusted. The printed pattern may offset in different directions and in different sizes, mainly because that a squeegee blade exerts a pressure on the screen during a moving process, and various positions of the screen will experience different tensions with the movement, as a result of different tensions, the printed pattern will offset from the target pattern.

BRIEF DESCRIPTION

The present disclosure provides a screen printing device which is capable of effectively adjusting the tension of a printing mesh in the screen printing device to improve print offset of a printing material such as glass glue.

The embodiments of the present disclosure provides a screen printing device, including a printing screen having a printing mesh and a mesh frame, a squeegee blade for printing a printing material to a substrate to be printed through the printing screen, wherein the printing mesh has a first longitudinal end, a second longitudinal end, a first blank area at the first longitudinal end, a second blank area at the second longitudinal end, and a printing portion with printed patterns between the first blank area and the second blank area, the first blank area and the second blank area being movably connected to the mesh frame by a tension adjusting mechanism respectively, and being provided with at least one tension sensor respectively approximate to the printing portion, wherein the screen printing device further includes a control means configured to receive a tension measurement value from the at least one tension sensor and compare it with a reference value, so as to control the tension adjustment mechanism to adjust the tension in the printing mesh.

The control means is configured to loosen the printing mesh by the tension adjusting mechanism when the tension measurement value is greater than the reference value, and to tighten the printing mesh by the tension adjusting mechanism when the tension measurement value is less than the reference value.

In an embodiment of the present disclosure, the tension adjusting mechanism includes a winding shaft rotatably disposed at each end of the mesh frame, and the first blank area and the second blank area of the printing mesh are fixedly connected to a corresponding winding shaft respectively, and a portion of the first blank area and the second blank area is wound onto the corresponding winding shaft.

In an embodiment, the winding shafts are each configured to have at least two sections that are rotatable relative to each other, and the portion of the blank area of the printing mesh that is wound onto the winding shaft is divided into at least two independent segments along a transverse direction of the printing mesh. The at least two sections of the winding shaft correspond to the at least two segments of the printing mesh.

In an embodiment, the winding shaft includes four sections, the printing mesh including four segments, and four tension sensors are arranged respectively approximate to the printing portion in the first blank area and the second blank area.

In the present disclosure, the substrate to be printed is embodied as an OLED packaging substrate, and the printing material as glass glue.

The present disclosure further provides a method for adjusting the tension of the printing mesh of the screen printing device, the method including moving the squeegee blade in a longitudinal direction of the printing mesh, receiving a tension measurement value from the tension sensor by the control means to compare the tension measurement value with a reference value such that if a measured value is greater than the reference value, the printing mesh is loosened by the tension adjusting mechanism until the measured value is substantially equal to the reference value, and if the measured value is smaller than the reference value, the printing mesh is tightened by the tension adjusting mechanism until the measured value is substantially equal to the reference value.

According to an aspect of the present disclosure, the tension adjusting mechanism includes a winding shaft rotatably disposed at an end of the mesh frame, the first blank area and the second blank area of the printing mesh are fixedly connected to a corresponding winding shaft respectively, and a portion of the first blank area and a portion of the second blank area are wound onto the corresponding winding shaft.

In the above method, in the moving direction of the squeegee blade, if the tension measurement value of the tension sensor located at the blank area upstream of the squeegee blade is greater than the reference value, the printing mesh is loosened by rotating the corresponding winding shaft, if the tension measurement value of the tension sensor at the blank area downstream of the squeegee blade is less than the reference value, the printing mesh is tightened by rotating the corresponding winding shaft.

According an aspect of the method, the winding shafts are each configured to have at least two sections that are rotatable relative to each other, and the portion of the blank areas of the printing mesh that is wound onto the winding shafts is divided into at least two independent segments along a transverse direction of the printing mesh. The at least two sections of the winding shaft correspond to the at least two segments of the printing mesh.

BRIEF DESCRIPTION OF THE DRAWINGS

The exemplary embodiments of the present disclosure are described below with reference to the drawings.

DETAILED DESCRIPTION

Figure 1:
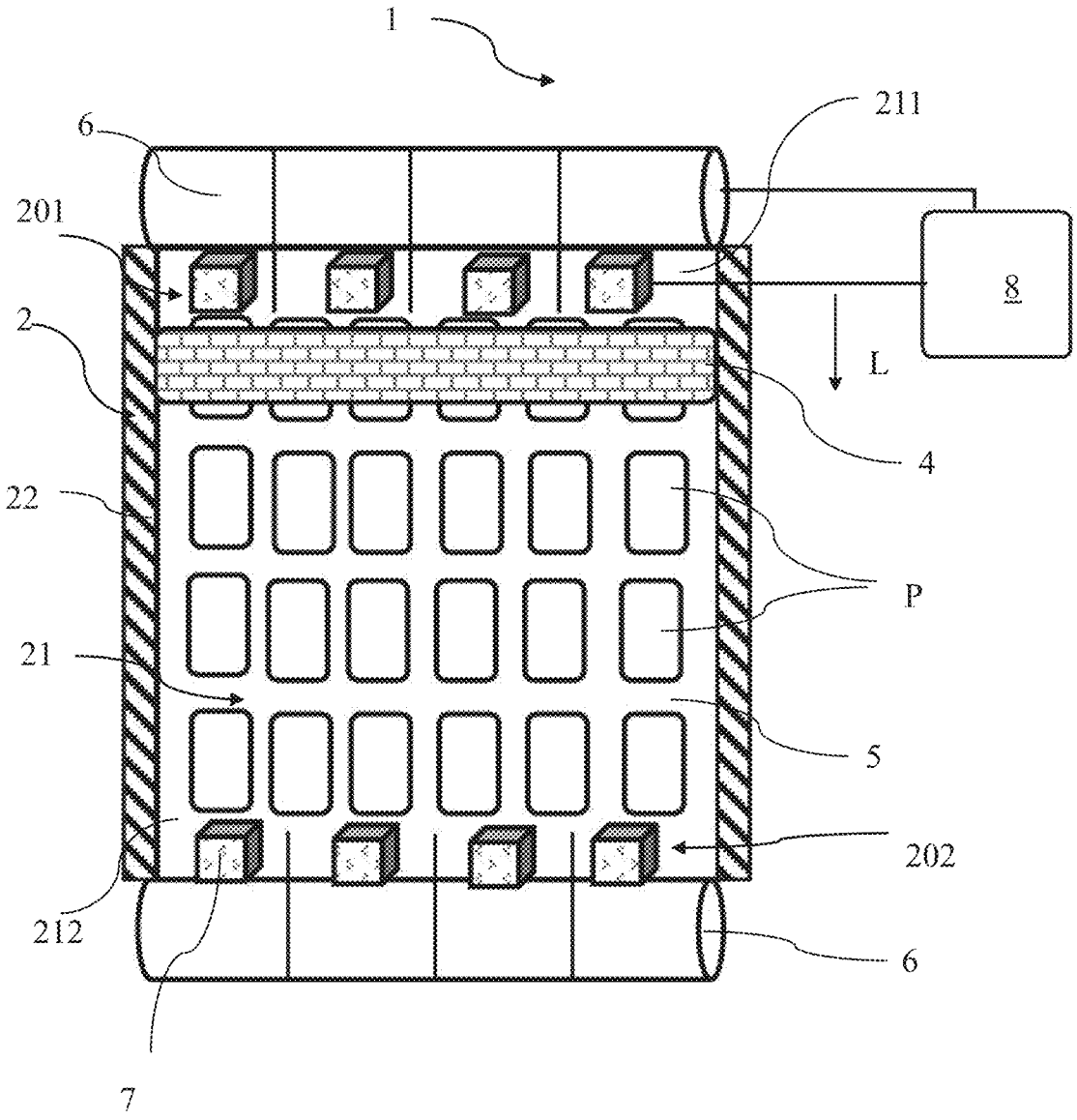
FIG. 1 is a top view of a screen printing device according to an embodiment of the present disclosure.

The exemplary embodiments of the present disclosure will be illustrated in detail below. The exemplary embodiments described below and shown in the drawings are intended to teach the principles of the present disclosure, enable those skilled in the art to carry out and use the present disclosure in different environments and different applications.

FIG. 1 shows a top view of a screen printing device according to an embodiment of the present disclosure. As can be seen from the figure, the screen printing device 1 includes a printing screen 2 having a printing mesh 21 and a mesh frame 22, and a squeegee blade 4 for printing a printing material, such as glass glue, onto a substrate to be printed by the printing screen 2. As shown, a longitudinal direction of the printing mesh is parallel with a moving direction L of the squeegee blade 4, the printing mesh 21 having a first longitudinal end 201 where a first blank area 211 is provided and a second longitudinal end 202 where a second blank area 212 is provided, and a printing portion 5 with a printed pattern P is located between the first blank area 211 and the second blank area 212.

In this embodiment, the first blank area 211 and the second blank area 212 are movably connected to the mesh frame 22 by a tension adjusting mechanism, respectively. In one aspect, the tension adjusting mechanism is configured to be rotatably mounted on a winding shaft 6 of the mesh frame 22, the ends of the first blank area 211 and the second blank area 212 are fixedly connected to the winding shaft 6, respectively, and a portion of the first blank area 211 and the second blank area 212 is wound onto the corresponding winding shaft 6.

In order to better adjust the tension of the printing mesh 21, the winding shaft 6 may be configured to have at least two sections those are rotatable independently. For example, in the embodiment, the winding shaft 6 has four sections those are rotatable independently. Those skilled in the art should understand that the numbers of the sections are exemplary only and that 2, 3, 5, or other suitable numbers of sections may be provided depending on the width of the printing screen. Accordingly, the portion of the first blank area 211 and the second blank area 212 that is wound onto the winding shaft 6 can be divided into at least two segments along a transverse direction of the printing mesh, for example, four segments in this embodiment. Generally, the segment number of the printing mesh may correspond to the section number of the winding shaft to facilitate tension adjustment.

In one embodiment, according to the section number of the winding shaft and the section number of the printing mesh, four tension sensors 7 may be respectively disposed approximate to the printing portion 5 in the first blank region 211 and in the second blank region 212.

The printing screen device 1 according to the present disclosure further includes a control means 8 in communication with the tension sensors 7 and configured to receive the tension measurement value from the tension sensors 7 and to compare the tension measurement value with the reference value so as to control the tension adjusting mechanism. That is, the tension value of the printing mesh is adjusted by rotating the winding shaft 6 in clockwise direction or in counterclockwise direction. Here, the reference value is defined as a tension value of the printing mesh during normal printing.

The squeegee blade 4 exerts pressure on the printing mesh 21 during the printing and moving process. As the squeegee blade 4 moves, the tension at different positions of the printing mesh also varies, which results in non-uniform tension in the entire printing mesh.

Figure 2:
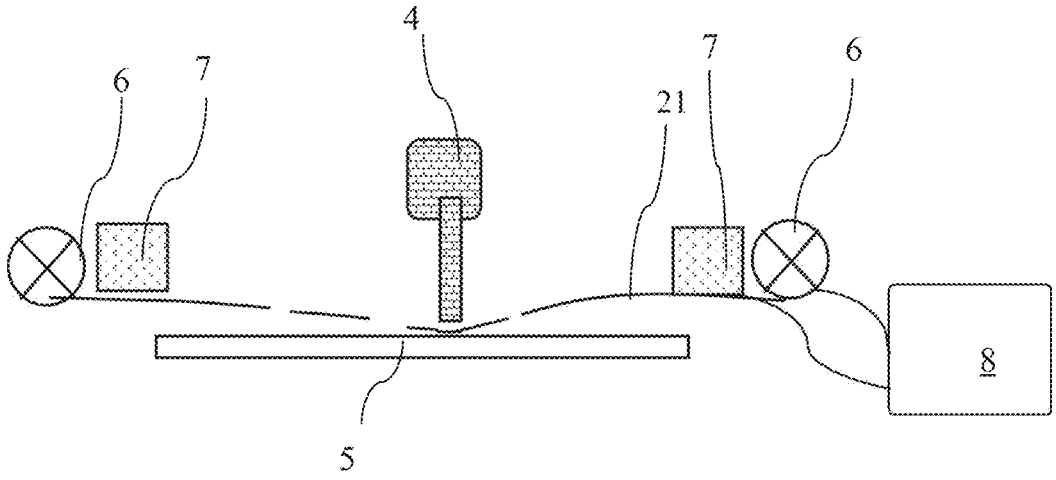
FIG. 2 is a side view of the screen printing device of FIG. 1.

Generally, as shown in FIG. 2, the tension measurement value of the tension sensor 7 in the blank area upstream of the squeegee blade 4, i.e., the first blank area 211 along the moving direction L of the squeegee blade will be increased to be greater than the reference value. In this case, the printing mesh can be loosened by rotating a corresponding section of the winding shaft 6. The tension measurement value of the tension sensor 7 at the blank area downstream of the squeegee blade 4, i.e., the second blank area 212, is reduced to be less than the reference value. In this case, the printing mesh can be tightened by rotating the corresponding section of the winding shaft 6, thereby overcoming the problem of non-uniform tension in the printing mesh. In this case, the printing material, such as glass glue, will be prevented from offset, thereby improving the offset between the printed pattern and the target pattern.

It should be noted that the above description is only exemplary, and various modifications and variants can be made to the embodiments of the present disclosure in light of the above description, and such modifications and variations are encompassed within the protection scope of the present disclosure.

What is claimed is:

1. A screen printing device comprising:

a printing screen having a printing mesh and a mesh frame; and a squeegee blade for printing a printing material to a substrate to be printed through the printing screen;

wherein the printing mesh has a first longitudinal end, a second longitudinal end, a first blank area at the first longitudinal end, a second blank area at the second longitudinal end, and a printing portion with printed patterns between the first blank area and the second blank area, the first blank area and the second blank area movably connected to the mesh frame by a tension adjusting mechanism respectively and provided with at least one tension sensor respectively proximate to the printing portion; and wherein the screen printing device further comprises a controller, a tension measurement value from the at least one tension sensor being received and compared with a reference value by the controller to control the tension adjustment mechanism so as to adjust the tension in the printing mesh, the tension adjusting mechanism includes a winding shaft rotatably disposed at each end of the mesh frame, wherein the first blank area and the second blank area of the printing mesh are fixedly connected to a corresponding winding shaft, and wherein a portion of the first blank area and a portion of the second blank area are wound onto the corresponding winding shaft respectively.

2. A screen printing device according to claim 1, wherein the controller is configured to loosen the printing mesh by the tension adjusting mechanism when the tension measurement value is greater than the reference value, and to tighten the printing mesh by the tension adjusting mechanism when the tension measurement value is less than the reference value.

3. A screen printing device according to claim 1, wherein the winding shafts are each configured to have at least two sections that are rotatable relative to each other, wherein the portion of the blank area of the printing mesh that is wound onto the winding shaft is divided into at least two independent segments along a transverse direction of the printing mesh, and wherein the at least two sections of the winding shaft correspond to the at least two segments of the printing mesh.

4. A screen printing device according to claim 3, wherein each of the winding shafts comprises four sections and the printing mesh comprises four segments, and wherein four tension sensors are respectively disposed in the first blank area and the second blank area proximate to the printing portion.

5. A screen printing device according to claim 1, wherein the substrate to be printed is an OLED packaging substrate, and wherein the printing material is a glass glue.

6. A method for adjusting the tension in the printing mesh of the screen printing device according to claim 1, the method comprising:

moving the squeegee blade in a longitudinal direction of the printing mesh;

receiving the tension measurement value from the at least one tension sensor and comparing the tension measurement value with the reference value by the controller; and loosening the printing mesh by the tension adjusting mechanism until the tension measurement value is substantially equal to the reference value if the tension measurement value is greater than the reference value, and tightening the printing mesh by the tension adjusting mechanism until the tension measurement value is substantially equal to the reference value if the tension measurement value is smaller than the reference value, the tension adjusting mechanism including a winding shaft rotatably disposed at each end of the mesh frame, the first blank area and the second blank area of the printing mesh fixedly connected to a corresponding winding shaft respectively, and a portion of the first blank area and a portion of the second blank area wound onto the corresponding winding shaft respectively.

7. A method according to claim 6, further comprising, in the moving direction of the squeegee blade, if the tension measurement value of the tension sensor located at the blank area upstream of the squeegee blade is greater than the reference value, loosening the printing mesh by rotating the corresponding winding shaft, and if the tension measurement value of the tension sensor at the blank area downstream of the squeegee blade is less than the reference value, tightening the printing mesh by rotating the corresponding winding shaft.

8. A method according to claim 6, further comprising configuring each of the winding shafts to have at least two sections that are rotatable relative to each other, wherein the portion of the blank areas of the printing mesh that is wound onto the winding shafts is divided into at least two independent segments along a transverse direction of the printing mesh, and wherein the at least two sections of the winding shaft correspond to the at least two segments of the printing mesh.

* * * * *